US005707004A

United States Patent [19]

Cai

[11] Patent Number: 5,707,004

[45] Date of Patent: Jan. 13, 1998

[54] CARTON WITH OFFSET LOCK

[75] Inventor: Liming Cai, West Chester, Pa.

[73] Assignee: Dopaco, Inc., Downingtown, Pa.

[21] Appl. No.: 779,448

[22] Filed: Jan. 7, 1997

[51] Int. Cl.[6] ..... B65D 43/00

[52] U.S. Cl. ..... 229/148; 229/114; 229/933

[58] Field of Search ..... 229/114, 146, 229/148, 933

[56] References Cited

U.S. PATENT DOCUMENTS

| | | | |
|---|---|---|---|
| 3,019,958 | 2/1962 | Asman et al. . | |
| 3,404,829 | 10/1968 | Stone | 229/148 |
| 4,126,266 | 11/1978 | Roccaforte . | |
| 4,341,339 | 7/1982 | Zore . | |
| 4,729,508 | 3/1988 | Erdmann et al. | 229/933 |
| 4,763,832 | 8/1988 | Forbes, Jr. . | |
| 4,930,681 | 6/1990 | Fultz et al. | 229/148 |
| 4,951,865 | 8/1990 | Eisman . | |
| 4,960,238 | 10/1990 | Lorenz | 229/114 |
| 5,044,549 | 9/1991 | Beales . | |
| 5,188,284 | 2/1993 | Eisman . | |
| 5,603,450 | 2/1997 | Whitnell | 229/148 |

*Primary Examiner*—Gary E. Elkins

*Attorney, Agent, or Firm*—Dennison, Meserole, Pollack & Scheiner

[57] ABSTRACT

A single latch assembly integrally with the front walls of the tray and cover of a clamshell carton and positioned solely to one side of the transverse center line of the front walls in the area of maximum strength of each front wall. The latch assembly component on the tray includes an inwardly directed elongate flange and an outwardly directed tongue at the top edge of the tray front wall positioned solely between the central area of the top edge and one end thereof. The latch assembly component on the cover includes an elongate aperture defined through the cover front wall immediately adjacent the top panel of the cover.

8 Claims, 2 Drawing Sheets

CARTON WITH OFFSET LOCK

BACKGROUND OF THE INVENTION

Folded paperboard cartons for use as fast food containers are provided in a variety of configurations and utilize lock assemblies normally integrally defined from the sheet material of the carton itself.

One form of carton is commonly referred to as a clamshell carton and includes a walled tray with a walled cover hinged thereto and foldable thereover along an appropriate hinge line between the rear portions of the tray and cover. The cover is releasably retained in a closed position by an integral lock or latch assembly normally associated with the forward walls of the tray and cover.

A frequently used latch assembly is illustrated in U.S. Pat. No. 5,044,549, issued to Beales on Sep. 3, 1991.

In Beales, which actually provides for separately formed tray and cover components, the latch assembly includes a rearwardly directed upper flange associated with and coextensive with the upper edge of the front tray wall, the flange including a forwardly directed coplanar latching tongue centrally therealong. A corresponding latch opening or aperture, selectively receiving the latch tongue, is formed centrally in the front wall of the cover immediately below the top panel thereof for a snap locking and forward projection of the latch tongue through the latch opening as the cover is closed and the latch tongue aligns with the aperture opening immediately outward thereof. The relationship between the tray and cover is such as to inwardly deflect the latch tongue as the front wall of the cover engages thereagainst and moves downward until such time as the latch tongue aligns with the latch opening. Release of the cover in Beales requires the application of inwardly directed pressure centrally on a component of the tray front wall through a finger recess in the front wall of the tray centrally aligned with the latch aperture.

Such an arrangement, with the latch assembly centrally along the front walls of the tray and cover, results in a positioning of the latch assembly at the weakest points of these walls. In other words, there is minimal support for the front walls against lateral flexure. As such, there is a tendency for this form of latch assembly to accidentally disengage, for example while grasping the closed carton in one's hand. In other words, any slight pressure on the forward walls of the tray will meet with little lateral resistance and tend to release the latch.

Further, inasmuch as the material of folding cartons used in the fast food industry tends to be of minimum thickness, with the desired strength achieved by the relationship between the folded components, the individual walls have minimal lateral strength. This has been found to be acceptable in that the cartons are subjected to substantially no internal forces as might disrupt the carton, the received foodstuffs normally being of no appreciable weight and retained for only short periods of time. However, because of lateral weakness in the walls, and particularly the latched forward walls, there is frequently a tendency for the latch assembly to not properly latch, or only partially latch.

SUMMARY OF THE INVENTION

The carton of the present invention is basically a clamshell carton which has been uniquely modified to retain all of the benefits of the conventional carton while reducing the amount of material required in the construction of the carton, enhancing the strength thereof and greatly increasing the stability and effectiveness of the latch assembly.

The multiple advantages, as compared to the conventional clamshell carton, require no changes in the conventional manufacturing procedures, and only minimal adjustment in the apparatus utilized in the die cutting of the paperboard sheets and the subsequent folding of the carton.

The goals of the invention are achieved in a manner which is both unobvious and a distinct forward step in a crowded art directed to constructions of little complexity wherein the common goals sought include an effective enclosure for foodstuff, economic and ecological advantages, principally arising from the use of a minimal amount of material and simplified or known assembly procedures, and the like.

While the invention will be described in terms of a clamshell carton, it is to be appreciated that the principles of the invention are equally applicable to other conventional forms of covered food cartons.

Structurally, the carton includes a tray with upstanding slightly outwardly inclined peripheral walls and a similarly configured cover with dependent peripheral walls. The rear walls of the tray and cover are hingedly joined for a selective pivotal opening and closing of the cover relative to the tray. The tray front wall is of a greater height than the remaining walls of the tray and extends to a height approximately equal to the combined heights of the tray and cover rear walls whereby, upon a closing of the cover over the tray, the upper edge of the tray front wall engages against the undersurface of the top panel of the cover. Other than for the hingedly joined rear walls, the peripheral walls of the cover, upon a closing of the cover over the tray, engage outwardly over the tray walls. The upper edge of the front wall of the tray includes, solely to one side of the central point therealong, a rearwardly folded flap or flange and a coplanar, forward, elongate latch tongue formed from the upper portion of the front wall immediately below the flange. The cover front wall, toward one end thereof and between the transverse center line thereof and the end, includes, immediately below the top panel, an elongate latch aperture which, upon a seating of the cover, receives the latch tongue therethrough. The front wall of the tray includes an inherent resilient flexibility which allows a slight lateral inward flexure of this front wall as the front wall of the cover closes thereover. Upon an alignment of the latch tongue with the latch opening, the resilient flexibility of the front wall will forwardly force the tongue into the latch aperture and thus releasably lock the cover to the tray until manually released.

The positioning of the latch assembly distinctly to one side of the center line of the front walls allows for a substantial reduction in the flange material heretofore utilized in the known cartons wherein the latch assembly is centrally positioned. This in turn allows for a substantial savings in material in that adjacent blanks or blank patterns in the sheet of material to be cut can be internested as will be illustrated. It is estimated that an approximate 5% saving in material results. Considering the vast number of such cartons which are daily used in the fast food industry, this saving is quite impressive. Similarly, the ecological advantages of the reduced amount of material used are also significant.

The positioning of the latch assembly toward one end of the front walls also results in a more effective latching in that, particularly in light of the relatively thin material normally used, the front walls toward the ends thereof are substantially more rigid, due to the adjoining side walls fixed thereto, than the central areas of the front walls whereat such latch assemblies are normally provided. Thus, once the latch tongue is engaged in the latch aperture, there is little tendency for any accidental flexure of the front walls being sufficient to disengage the tongue. In other words, there will be a much greater possibility of the side-located latch assembly remaining engaged as the closed carton is handled, stacked in a bag, and the like. By the same token, the rigidity of the entire carton and the structural integrity thereof will be increased in that the latch assembly, which is actually formed from the body of the carton, will be located at the area of maximum strength of the carton, rather than at the area of maximum weakness.

Additional features and advantages of the invention will become apparent from the more detailed description of the invention following hereinafter.

DESCRIPTION OF PREFERRED EMBODIMENTS

Referring now more specifically to the drawings, the carton 10, illustrated as a clamshell carton, is formed of an appropriate shape-sustaining foldable sheet material, preferably conventional paperboard. The sheet material is initially cut into a blank 12, noting FIG. 7, which is subsequently folded and glued to define the carton 10. As the carton itself is a single-use disposable item, the paperboard is of a minimal thickness capable of effectively containing the foodstuff until consumed. The strength of the carton 10 arises from the interrelationship of the components of the carton when formed.

Figure 1:
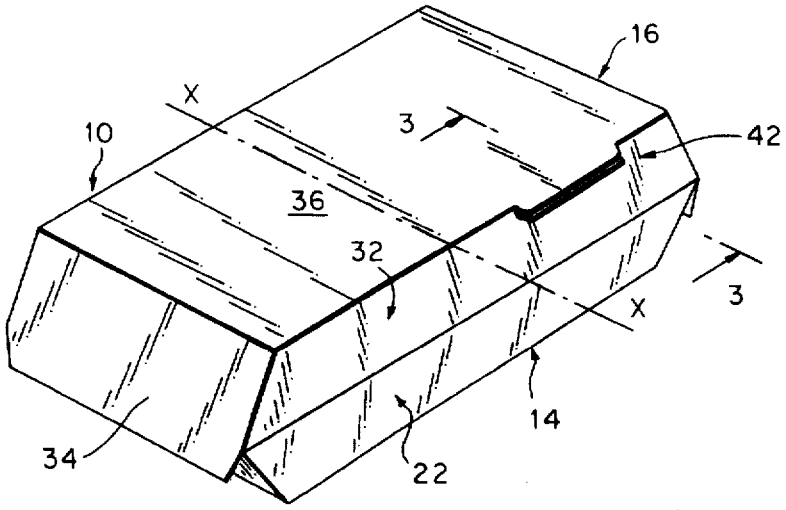
FIG. 1 is a perspective view of a closed carton with the latch assembly engaged.
Figure 2:
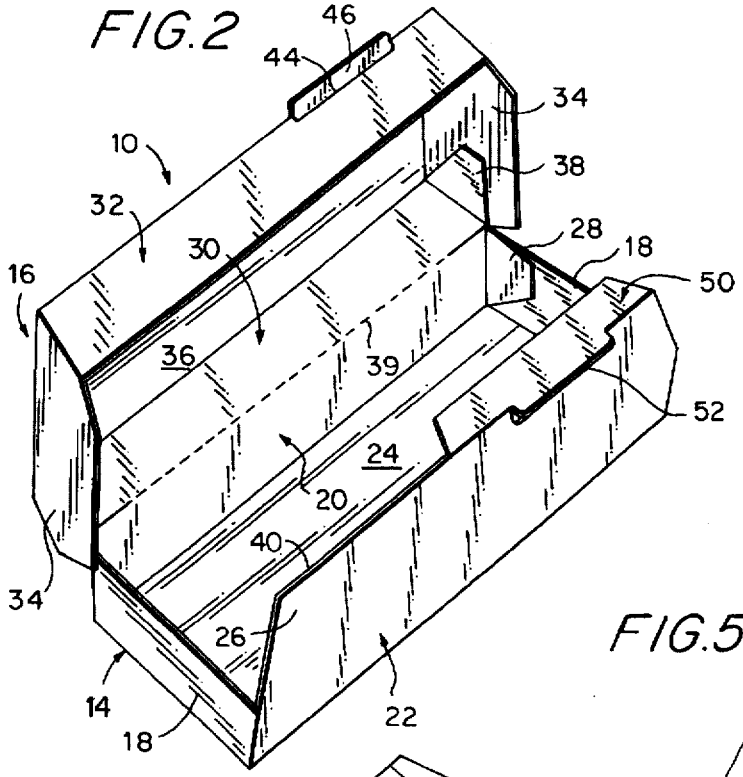
FIG. 2 is a perspective view of the carton with the cover partially open.
Figure 3:
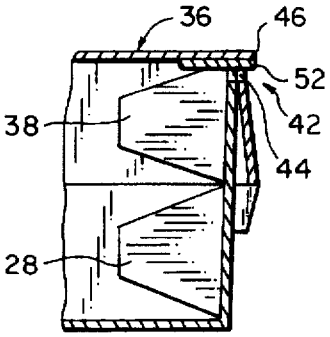
FIG. 3 is an enlarged cross-sectional detail taken substantially on a plane passing along line 3—3 in FIG. 1.
Figure 5:
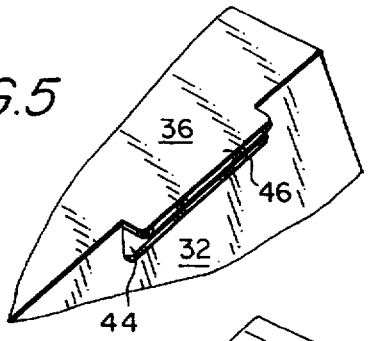
FIG. 5 is an enlarged perspective detail of the latch aperture component of the latch assembly defined through the front wall of the cover.
Figure 4:
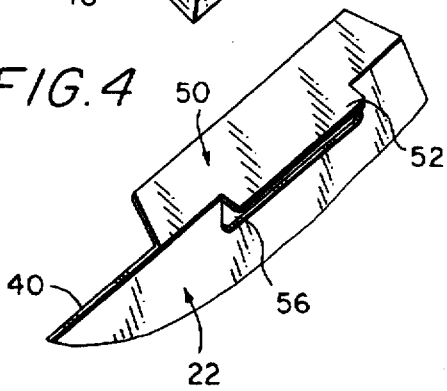
FIG. 4 is an enlarged perspective detail of the latch tongue component of the latch assembly on the tray front wall.
Figure 7:
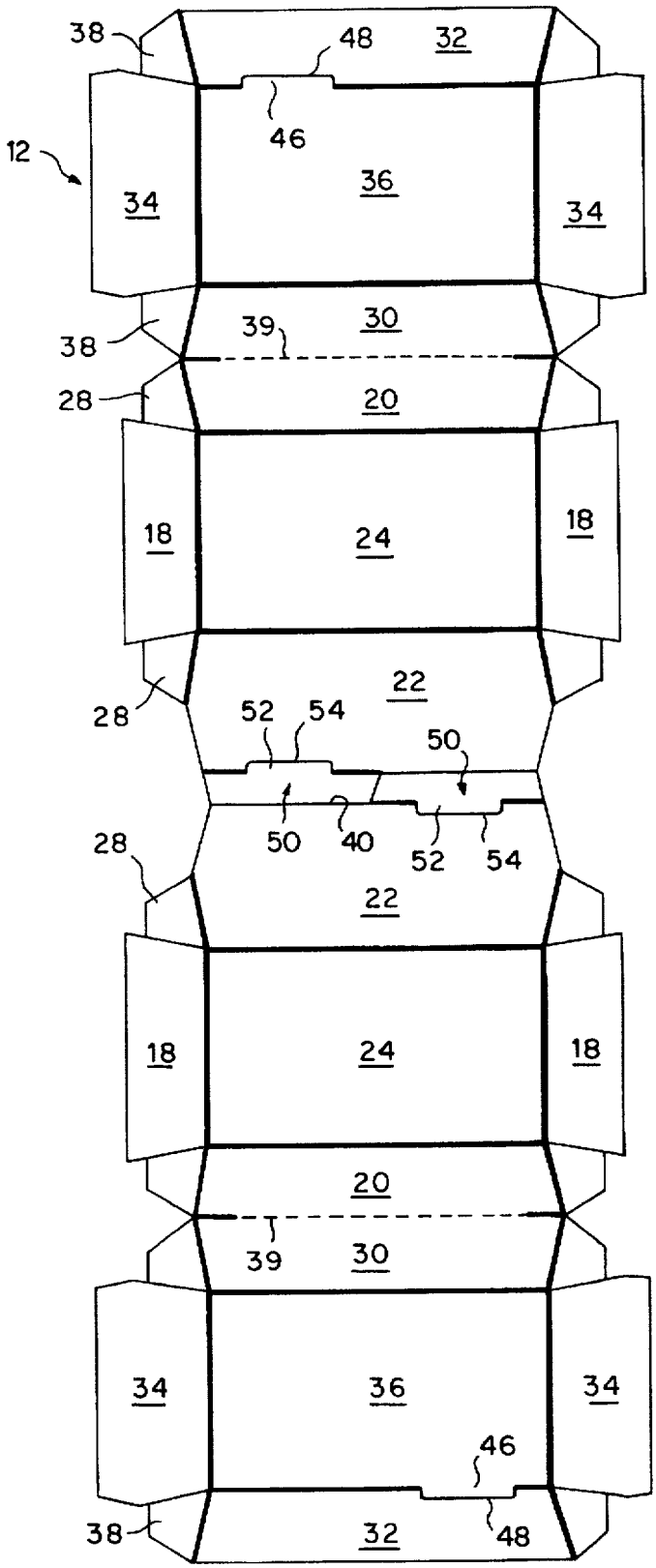
FIG. 7 is a plan view of a pattern of two blanks illustrating the internesting relationship thereof which reduces the amount of material required in the formation of the cartons and, correspondingly, reduces the bulk of the carton which must subsequently be disposed of in an ecologically feasible manner.

The carton 10 includes a tray 14 and a cover 16. The tray 14, as illustrated, includes spaced side walls 18, a rear wall 20, and a front wall 22 peripherally joined to and extending upward from a bottom panel 24. The side walls 18 and rear wall 20 are preferably of equal height with the front wall 22 having a height approximately twice that of the other walls. For purposes of description, that portion of the front wall 22 extending freely above the end joined side walls 18 is referred to as an extension 26. The front wall 22, including the extension 26, is basically a planar member with no line of weakness or fold line defined between the extension 26 and the remainder of the front wall 22 therebelow. Noting FIGS. 2 and 7 in particular, it will be seen that the tray walls 18, 20 and 22 are integral with and folded from the peripheral edges of the bottom panel 24, and are edge joined by integral glue flaps 28 on the opposed ends of the rear and front walls, such glue flaps being folded to overlie the inner faces of the opposed side walls 18 for adhesive bonding thereto. It is to be appreciated that the components of the blanks of FIG. 7 are designated by the same reference numerals as those components described in the assembled carton of FIGS. 1–5.

The cover 16 includes approximately equal height rear and front walls 30 and 32, and opposed relatively higher side walls 34. The cover walls 30, 32 and 34 extend outwardly from the periphery of a top panel 36 and are edge joined by appropriate glue flaps 38 integral with and foldable relative to the opposed ends of the rear and front cover walls 30 and 32.

The tray and cover rear walls 20 and 30 are integrally joined along the outer edges thereof with a full length fold line 39 defined thereat and forming an integral hinge about which the cover is selectively closed and opened.

The peripheral walls of the tray 14 and cover 16 are slightly outwardly flared from their respective panels 24 and 36 with the relationship between the respective tray and cover walls being such wherein, upon a closing of the cover 16 over the tray 14, the cover walls, other than for the cover rear wall 30, overlap and lie outward of the respective tray side walls 18 and front walls 22. This desired closing relationship is encouraged by the extended height of the cover side walls 34 and, if necessary, a slight inward arcing of the tray front wall extension 26 upward from the upper edges of the tray side walls 18. In order to provide for a stable closed carton, the front wall 22 is of a height equal to the combined heights of the hinge joined rear walls 20 and 30 whereby the upper edge 40 of the front wall or front wall extension 26 will engage the top panel 36 of the cover 16 immediately inward of the cover front wall 32.

The latch assembly 42, utilized to securely although releasably retain the cover 16 in its closed position over the tray 18, is specifically formed integral with the carton and to one side of the transverse center line X—X of the carton, centrally between this center line and one side of the carton. In forming the latch assembly, an elongate latch aperture or opening 44 is formed in the front wall 32 of the cover 16 immediately below the cover top panel 36. Overlying the latch aperture 44 is an elongate lip 46 which is a rigid integral extension of the top panel 36. As will be appreciated from FIGS. 5 and 7 in particular, the lip 46 is actually defined from the cover front wall 32 by a cut line 48 and retained in the plane of the top panel 36 as the cover front wall 32 is downwardly folded. This in turn defines the latch aperture 44.

In order to define the tray component of the latch assembly 42, an elongate flange 50 is provided along approximately one-half of the length of the front wall upper edge 40, extending from one end thereof to the transverse mid-point of the carton. The flange 50, in the carton, extends laterally toward the interior of the tray and includes a rigid outwardly directed latch tongue 52 integral therewith and defined from the tray front wall 22 by a cut line 54, as best seen in the blanks of FIG. 7. In forming the latch tongue 52, a corresponding elongate opening 56 is provided in the tray front wall 22 immediately therebelow. The latch tongue 52 is of a length so as to be closely received through the latch aperture 44.

When the carton 10 is to be closed, for example after the introduction of the foodstuffs, the cover 16 is downwardly pivoted toward the tray. The tray front wall extension, and the latch tongue 52 engage against the inner surface of the cover front wall 32 as this front wall slides downwardly until the latch tongue flange 50 engages against the undersurface of the cover top panel. This engagement automatically horizontally orients the latch tongue flange 50 and aligns the latch tongue 52 for automatic forward biasing into engagement through the latch aperture 44. This automatic forward engagement of the latch tongue is an inherent result of the resilient flexibility of the tray front wall 22, and in particular the extension 26 thereon and the inherent memory thereof which returns the extension 26 to its forward, at-rest position following a release of the inward pressure thereon by the cover front wall 32 upon alignment of the latch tongue 52 with the latch aperture 44. The engaged latch assembly is protected by the overlying lip 46 against accidental release of the latch assembly by directly engaging the latch tongue. Disengagement of the latch assembly by withdrawal of the latch tongue 52 from the latch aperture 44 is effected by a slight pressure on the front wall 22 of the tray 14 below and in alignment with the latch assembly.

Figure 6:
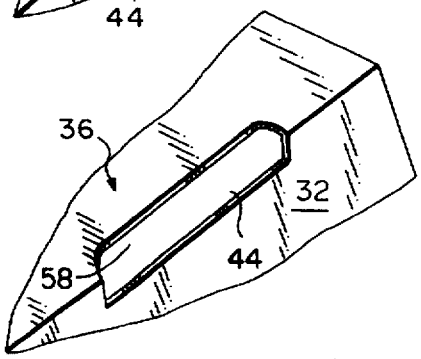
FIG. 6 is a perspective detail of a variation in the latch aperture structure.

FIG. 6 is of interest in illustrating another embodiment of latch aperture 44 wherein, rather than providing for the protective forwardly extending lip 52, a recess 58 is defined in the cover top panel 36 communicating with and extending inward from the aperture 44. With this recess, the latch tongue can be released by direct manual rearward pressure thereagainst, the recess accommodating the rearward movement of the pressure finger.

The positioning of the latch assembly 42 toward one end of the tray and cover front walls 22 and 32 is significant in that these walls, braced and supported by the immediately adjacent side walls 18 and 34 are substantially more rigid adjacent the end portions as opposed to a central location which is substantially unsupported against lateral flexure. The greater rigidity of the wall end portions wherein the latch assembly of the invention is defined provides for a more positive engagement and retention of the tongue within the latch aperture, reducing the likelihood of an accidental release of the cover. The additional pressure which might be required to release the side located latch assembly is minimal and clearly warranted by the enhanced lock relationship achieved.

Noting FIG. 7, two blanks 12 in accord with the invention are aligned therein in the relationship between the blanks as they are cut from a single sheet of material. Viewed in another way, FIG. 7 can be considered an illustration of adjacent blank patterns. Of particular significance is the laterally adjacent relationship of the latch tongue flanges 50, one on each blank, which provide a nesting between adjacent blanks and, through an elimination of the full length latch flanges of conventional cartons and the central location of conventional latch tongues, provides a substantial reduction in the amount of material required. This reduction in material, which has been calculated to be approximately 5% on each carton, actually results in a tremendous savings in material when considering the thousands of such cartons used daily in the fast food industries for hamburgers, pizzas, and the like.

In summary, the carton of the present invention incorporates a latch assembly which in the novel location thereof, and the reliance thereof on the stabilizing effects of the relationship between the carton walls, provides for a more positive and secure engagement of the lock assembly components, and a substantial reduction in the material used. The carton of the invention not only includes all of the desirable features of known cartons, but also significantly improves thereon.

The foregoing is illustrative of the principles of the invention, such having been described in connection with what might be considered a clamshell carton of the type normally used to accommodate a hamburger or like type sandwich. The features which define the invention, as will be recognized, can equally be incorporated into a variety of similar cartons. Accordingly, the illustrated embodiment is not to be considered a limitation on the scope of the invention. Rather, the invention is more particularly defined by the claims following hereinafter.

I claim:

1. A carton formed of folded shape-sustaining sheet material, said carton comprising a tray and a cover, said tray including a bottom panel, an elongate front wall with opposed ends, side walls joined to said front wall at said opposed ends and extending rearwardly therefrom, and a rear wall joined to and extending between said side walls in rearwardly spaced relation to said front wall, said walls being peripherally joined to said bottom panel and extending upward therefrom, said cover being pivotally secured to said tray rear wall for movement of said cover between a first open position remote from said tray and a second closed position overlying said tray, said cover including a top panel with a front wall depending therefrom and, in said closed position, overlying said tray front wall, said tray front wall including an upper edge extending to and between said opposed front wall ends, said upper edge having a central portion, an elongate flange integral with said upper edge solely between said upper edge central portion and one of said opposed ends of said front wall, said flange extending rearwardly relative to said front wall, a latch tongue defined as an integral extension of said flange extending forwardly of said front wall at said front wall upper edge and at an intermediate area along said flange between said upper edge central portion and said one of said opposed ends of said tray front wall, and a latch aperture defined through said cover front wall and aligned with said latch tongue in said closed position of said cover for locking reception of said latch tongue through said latch aperture.

2. The carton of claim 1 wherein said tray side and rear walls are of substantially equal height, said tray front wall being of greater height than said tray side walls and extending upwardly therebeyond, said cover including a rear wall depending from said top panel, said cover rear wall and said tray rear wall being integrally joined with a fold line defined therebetween and provided for the movement of said cover relative to said tray.

3. The carton of claim 2 wherein said latch aperture is positioned immediately below said cover top panel.

4. The carton of claim 3 including an integral lip on said cover top panel projecting forwardly of said cover front wall in overlying relation to said latch aperture.

5. In a clamshell carton having a tray with a bottom panel and peripheral walls including a rear wall and a front wall, and a cover with a top panel and peripheral cover walls including a rear wall and a front wall, hinge means joining said rear walls for a selective movement of said cover between an open position remote from said tray and a closed position overlying said tray, and a latch assembly integrally formed with said front walls for releasably retaining said cover in said closed position; the improvement wherein said front walls are substantially coextensive and of a predetermined length terminating in opposed ends, said latch assembly being positioned solely between one of said opposed ends and a midpoint along said predetermined length, said latch assembly including a latch tongue integral with said tray front wall and extending forwardly therefrom, and a latch aperture defined through said cover front wall for reception of said latch tongue.

6. The carton of claim 5 wherein said tray front wall includes an upper edge, and a flange integral with said upper edge solely to one side of said mid-point and aligned with said latch tongue, said flange extending rearwardly relative to said tray front wall.

7. The carton of claim 6 wherein said peripheral walls of said tray include side walls extending between the rear wall and front wall of said tray, said tray side walls and rear wall being of substantially equal height, said tray front wall being of a height substantially equal to the combined height of said tray rear wall and said cover rear wall in said closed position of said cover.

8. The carton of claim 7 including an integral lip on said top panel, said lip being coplanar with said top panel and projecting forwardly of said cover front wall into overlying relation to said latch aperture defined immediately therebelow.

* * * * *